United States Patent [19]

Hayashi

[11] 4,455,855

[45] Jun. 26, 1984

[54] FORMING ROLLS OF PIPE-PRODUCING APPARATUS

[75] Inventor: Masayuki Hayashi, Toda, Japan

[73] Assignee: Kabushiki Kaisha Sanyo Seiki, Wako, Japan

[21] Appl. No.: 342,703

[22] Filed: Jan. 25, 1982

[51] Int. Cl.[3] ..... B21D 5/12

[52] U.S. Cl. ..... 72/178; 72/180; 72/51; 29/125

[58] Field of Search ..... 72/178–182, 72/176, 51, 52; 228/149–151, 146, 147, 17, 17.5; 29/124, 125, 130

[56] References Cited

U.S. PATENT DOCUMENTS

| | | | |
|---|---|---|---|
| 726,691 | 4/1903 | Johnson | 72/180 |
| 1,377,252 | 5/1921 | Hunker | 72/178 |
| 2,182,842 | 12/1939 | Firth | 29/124 |
| 3,355,922 | 12/1967 | Utashiro et al. | 72/179 |
| 4,269,055 | 5/1981 | Sivachenko et al. | 72/180 |
| 4,317,350 | 3/1982 | Sivachenko et al. | 72/180 |

FOREIGN PATENT DOCUMENTS

| | | | |
|---|---|---|---|
| 706936 | 7/1931 | France | 72/52 |
| 148200 | 4/1982 | Japan . | |
| 7755 | of 1902 | United Kingdom | 72/176 |
| 527094 | 10/1940 | United Kingdom | 72/51 |

*Primary Examiner*—Daniel C. Crane

*Attorney, Agent, or Firm*—Wenderoth, Lind & Ponack

[57] ABSTRACT

Forming rolls of a tube-producing apparatus comprise an upper roll having two identical roll parts supported at spaced-apart positions on a roll shaft, each roll part having a rounded outer circumferential working surface which, as viewed in section taken along a plane passing through the rotational axis of the roll, has a rounded convex profile shape of mutually different inner and outer radii of curvature on inner and outer sides of the profile centerline perpendicular to the axis, the working surface portion of the outer radius operating cooperatively with the outer portion of a lower roll to form the lateral portion of a strip metal plate passed therebetween. Each upper roll part can be turned around in orientation on the roll shaft to place the working surface of the originally inner radius on the outer side, thereby changing the gap between the upper and lower rolls to suit the wall thickness of the tube being produced.

2 Claims, 2 Drawing Figures

FORMING ROLLS OF PIPE-PRODUCING APPARATUS

CROSS-REFERENCE TO RELATED APPLICATION

This application is related to U.S. patent application Ser. No. 342,702, filed on the same day as this application.

BACKGROUND OF THE INVENTION

This invention relates generally to the production of metal tubes or pipes and more particularly to curling or forming rolls of an apparatus for producing welded-seam tubes or electric-resistance welded tubes in which a skelp or a long, ribbon-like piece of metal (hereinafter referred to collectively as a "plate") is passed through a series of forming rolls and thereby formed into a tubular shape.

DESCRIPTION OF THE PRIOR ART

In a typical tube-producing apparatus of a known type, several pairs of upper and lower rolls are arranged in a row and function to strongly curl or curve a plate to be rolled into a concave cross-sectional shape. Several pairs of left and right rolls are further disposed in a row and function to successively press the lateral sides of the plate thus curved into arcuate cross-sectional shape and then progressively into a circular shape. Finally, the lateral edges are formed by fin rolls, and the tubular structure is conveyed to a succeeding welding step for welding the seam. There are also tube-producing apparatuses of the type wherein, in the initial stage of shaping by pressing, the plate is formed into a wave form to improve the forming of edge portions of the plate.

In each type of apparatus, however, since a tube is formed from a plate of a specific thickness, the forming rolls must, inconveniently, be changed when tubes of different wall thicknesses are to be produced, even when the wall thickness difference is very minute.

SUMMARY OF THE INVENTION

It is an object of this invention to provide forming rolls of a tube-producing apparatus which rolls are not accompanied by the above described inconvenience and are capable of forming plates for tubes of at least two different wall thicknesses without change of rolls.

According to this invention, briefly summarized, there are provided forming rolls of an apparatus for producing tubes from long strips of metal plate, said forming rolls comprising, in combination: a lower roll of an outer circumferential working surface which, as viewed in section taken along a plane passing through the rotational axis of the roll, has a smooth profile in the shape of a reflexed, recurved bow, the axially outer parts thereof being two symmetrical concavities of a radius of curvature approximately equal to the radius of the tube to be produced and being smoothly joined together by a convex middle part; and an upper roll having first and second roll parts of identical shape and dimensions coaxially supported at spaced-apart positions on a roll shaft, each roll part having a rounded outer circumferential working surface which, as viewed in section taken along a plane passing through the rotational axis of the roll, has a smooth profile of rounded convex shape of mutually different inner and outer radii of curvature on inner and outer sides of the centerline of the profile perpendicular to said axis, the outer radii respectively of the first and second roll parts being equal and the inner radii respectively thereof being equal, the outer portion of the working surface of the outer radius of each roll part being positioned to confront the working surface of a respective one of said symmetrical concavities of the lower roll and to carry out a forming operation cooperatively therewith on the metal plate interposed and passed therebetween, the orientation of each roll part of the upper roll on the roll shaft being inverted to interchange the positions of the parts thereof of the inner and outer radii, thereby to change a gap formed between the rolls to suit the wall thickness of the tube to be produced.

The nature, utility, and further features of this invention will be more clearly apparent from the following detailed description with respect to a preferred embodiment of the invention when read in conjunction with the accompanying drawing, briefly described below.

DETAILED DESCRIPTION OF THE INVENTION

Figure 1:
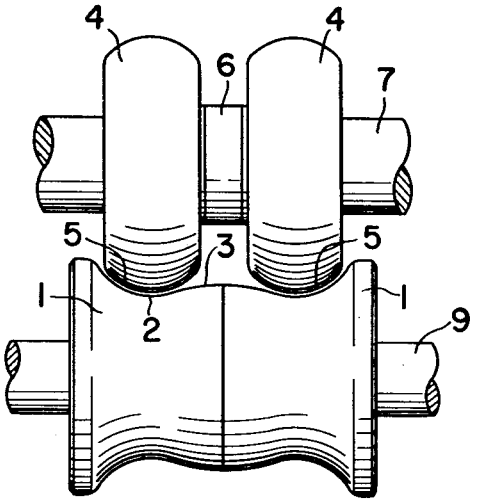
FIG. 1 is a view showing an example of the forming rolls according to this invention and being in a direction perpendicular to the plane passing through the centerline axes of the rolls.

The forming rolls according to this invention comprise, in combination, an upper roll having as its principal components two roll parts 4, 4 coaxially supported on a common roll shaft 7 and mutually spaced apart with spacer ring 6 interposed therebetween and a lower roll also having as its principal components two roll parts 1, 1 coaxially and contiguously supported in side-by-side disposition on a common roll shaft 9.

Figure 2:
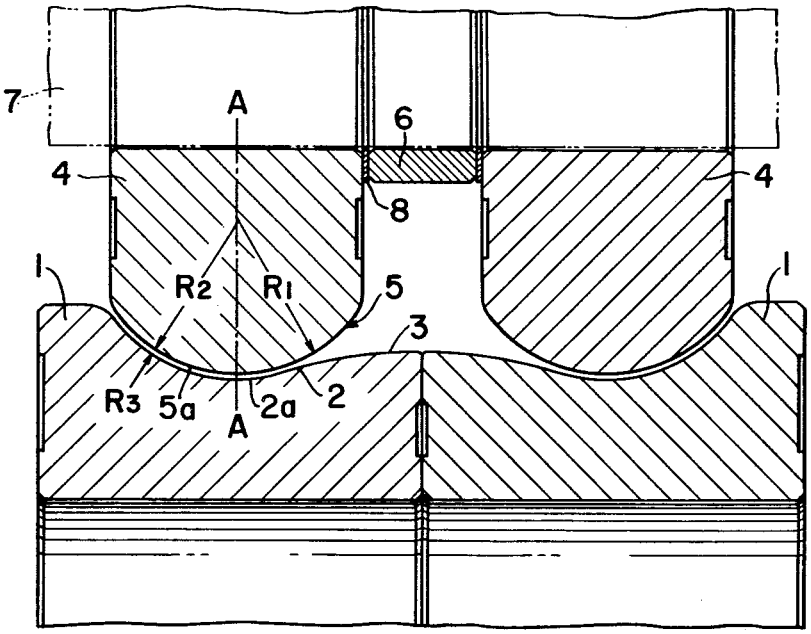
FIG. 2 is a fragmentary, relatively enlarged view, in section taken along the plane passing through the centerline axes of the same rolls, showing essential parts thereof.

The roll parts 1, 1 of the lower roll, which may be considered to be an unitary single roll, are provided around their outer circumferential working parts with respective annular depressions or concavities 2, 2, which, in section as shown in FIG. 2, have a radii of curvature substantially equal to the outer radius of a tube to be produced and have shapes that are symmetrical on opposite sides of the plane of juncture between the roll parts 1, 1. The concavely curved profiles of these concavities 2, 2 gradually inflect as they approach each other to form an annular middle convexity 3 in the vicinity of the plane of juncture between the roll parts 1, 1. Thus, the profile of the entire working surface of the lower roll, as viewed in section in FIG. 2, has the shape of a reflexed, recurved bow.

The concavities 2,2 are confronted by and operate cooperatively with the above mentioned roll parts 4,4, respectively, of the upper roll, particularly their axially outer parts. The roll parts 4,4 have annular convexly rounded surfaces 5,5 around their outer circumferential parts. As viewed in the section shown in FIG. 2, the rounded surface 5 of each roll part 4 has inner and outer portions on inner and outer sides of the roll part centerline A—A, which portions are of mutually different radii of curvature $R_1$ and $R_2$, which are very close to the inner radius of the tube to be produced.

The spacing between the above mentioned roll shafts 7 and 9 is so adjusted that a specific gap is generally maintained between the working surface 5 of each roll part 4 and the working surface of the concavity 2 of the corresponding roll part 1. Furthermore, the gap between the outer portion 5*a* of the working surface 5 of each roll part 4 and the outer portion 2*a* of the concavity 2 of the corresponding roll part 1 is adjusted and maintained at a specific value by means of a shim 8 of appropriate thickness interposed between the spacer 6 and that roll part 4. The working surface of the above mentioned outer portion 2*a* of each cancavity 2 is arcuate in section as viewed in FIG. 2 with a radius of curvature of $R_3$.

Depending on the wall thickness of the tube to be produced, the combination of the radius $R_1$ on one side of an upper roll part 4 or the radius $R_2$ on the other side thereof and the radius $R_3$ of the outer trough part of the lower roll part 1 is varied. As one specific example, the combination of $R_2=115.80$ mm, $R_1=116.70$ mm, and $R_3=119.0$ mm may be considered. In this case, as indicated in FIG. 2, in the case where the surface of the radius $R_2$ of the upper roll 4 confronts the concave surface of radius $R_3$ of the trough 2 of the lower roll part 1, the difference, or the gap, between these radii, $R_3-R_2$ or $119.0-115.8$, is 3.2 mm, whereby a tube of a wall thickness of 3.2 mm can be formed.

Furthermore, by drawing the upper roll parts 4,4 off from the roll shaft 7, turning these roll parts around, and remounting them on the shaft 7 with reversed orientation so that the surfaces of the radius $R_1$ are on the outer sides and thus caused to confront the surfaces of the radius $R_3$ of the lower roll 1, the gap between each pair of confronting surfaces becomes $R_3-R_1$ or 119.0 mm − 116.70 mm, whereby a tube of a wall thickness of 2.3 mm can be formed. In the case of tube wall thicknesses intermediate between the above two values, the gap between the roll surfaces can be carried out by adjustably varying the corresponding shim 8. Thus, it will be apparent that the left and right upper roll parts 4,4 are fitted on their roll shaft 7 with symmetrical orientations such that surfaces of the same radius of curvature (either $R_1$ or $R_2$) are on the outer sides. In this connection, markings such as numerals indicating tube wall thickness may be punched on the flank faces of the upper roll parts 4,4 to facilitate rapid and correct selection of the working surfaces thereof.

In the operation of the forming rolls of the above described construction according to this invention, the upper roll 4,4 and the lower roll 1,1, which have been selected and prepared for the desired tube diameter and wall thickness, are driven in intercoupled rotation by driving means (not shown). A plate (not shown) of appropriate cross-sectional dimensions is passed between these rolls and thereby formed into a wave-like cross-sectional shape closely resembling that of the upper surface of the lower roll 1,1 as shown in FIG. 2. Particularly the two lateral edge portions of the plate formed by the roll surfaces 5*a*,5*a* and 2*a*,2*a* are positively and fully formed because of the shapes of these working surfaces. This is an important feature of these rolls and their action since it facilitates the succeeding forming steps and reduces spring-back. The portions of the plate thus formed by these rolls 4,4 and 1,1 are thereafter successively sent to succeeding tube forming steps.

Thus, in accordance with this invention as described above, tubes of two or more different wall thicknesses can be formed with the use of one pair of forming rolls. At the same time, the edge parts of the plate are positively and fully formed, whereby tube forming with little spring-like becomes possible.

What is claimed is:

1. In a rolling mill for the manufacture of a welded metal tube of circular cross-section, wherein the opposite edge portions of a long strip are curled so that they abut tightly against each other before its welding operation, forming rolls comprising, in combination:

a lower roll, being mounted on a lower roll shaft and having an outer circumferential working surface which, as viewed in section taken along a plane passing through the rotational axis of the roll, has a smooth continuous profile in the shape of a reflexed, recurved bow, the axially outer parts thereof being two concavities of symmetrical configuration of a radius of curvature approximately equal to the radius of the tube to be produced and being joined together by a convex middle part; and an upper roll having separate first and second roll parts of identical shape and dimensions supported at spaced-apart positions on a roll shaft, each roll part having a rounded outer circumferential working surface which, as viewed in section taken along a plane passing through the rotational axis of the upper roll, has a smooth profile of rounded convex shape with mutually different inner and outer radii of curvature on inner and outer sides of a centerline bisecting the profile and extending perpendicular to said rotational axis, the outer radii respectively of the first and second roll parts being equal and the inner radii respectively thereof being equal, the outer portion of the working surface of the outer radius of each roll part being positioned to confront the working surface of a respective one of said concavities of the lower roll with a gap therebetween substantially equal to the wall thickness of the metal tube to be produced and to carry out a forming operation cooperatively therewith on a metal plate passed therebetween, said upper roll shaft being positioned parallel to said lower roll shaft and with the convex middle part of the lower roll extending between the spacing of the spaced-apart separate first and second roll parts, so that the orientation of each roll part of the upper roll on the roll shaft is inverted to interchange the positions of the roll parts thereof of the inner and outer radii, thereby changing said gap to suit the wall thickness of the metal tube being produced, whereby the forming rolls can curl edge portions of the metal plate without a springback.

2. In a rolling mill according to claim 1, further comprising:

an annular spacer fitted around the roll shaft between the first and second roll parts of the upper roll, interchangeable annular shims interposed between the spacer and the roll parts, said gap between the working surfaces of the upper and lower rolls being further variable by appropriately interchanging the annular shims to values suitable for the wall thickness of the metal tube being produced.

* * * * *